United States Patent [19]

Verdouw

[11] 4,392,355

[45] Jul. 12, 1983

[54] COMBUSTION LINER

[75] Inventor: Albert J. Verdouw, Indianapolis, Ind.

[73] Assignee: General Motors Corporation, Detroit, Mich.

[21] Appl. No.: 876,254

[22] Filed: Nov. 13, 1969

[51] Int. Cl.[3] ..... F23R 3/00

[52] U.S. Cl. ..... 60/752

[58] Field of Search ..... 60/752, 755, 756, 757, 60/758, 760, 39.65, 39.66

[56] References Cited

U.S. PATENT DOCUMENTS 2,617,255 11/1952 Niehus ..... 60/39.65

3,413,704 12/1968 Addoms, Jr. et al. ..... 60/39.74 A

*Primary Examiner*—Stephen C. Bentley

*Assistant Examiner*—Maureen Ryan

*Attorney, Agent, or Firm*—Saul Schwartz

[57] ABSTRACT

A combustion liner for a gas turbine engine operating at high temperatures has portions of the combustion liner double-walled, with a narrow clearance between the inner and outer walls through which cooling air flows to cool the liner. The surfaces of the walls which define these cooling air inlets are roughened to increase heat transfer from the air to the wall. The walls are joined and held apart by spacing strips extending axially of the liner and bonded to the overlapping wall sections. Large combustion air inlet holes extend through the overlapping wall sections at some points. Auxiliary air inlets for liner cooling are provided downstream of these combustion air inlet holes.

3 Claims, 9 Drawing Figures

COMBUSTION LINER

The invention herein described was made in the course of work under a contract or subcontract thereunder with the Department of Defense.

DESCRIPTION

My invention relates primarily to liners for high heat release combustion chambers such as are used, for example, in gas turbine engines. It is particularly directed to provision of a combustion liner suitable for operation at very high temperatures, with the ratio of fuel to combustion air approaching stoichiometric. My invention is embodied in improved structure for cooling the walls of a combustion liner which is exposed to the hot combustion gases and also is heated by radiation from the flame within the liner requiring a minimum of cooling air.

Current improvements in the metallurgy of turbine parts and in provisions for cooling critical parts such as vanes and blades have made possible the use of very high temperature motive fluids in gas turbines as compared to what was feasible a few years ago. Also, the trend to ducted fan type engines, in which a great part of the engine thrust is developed by a relatively large capacity fan driven by the gas turbine, and therefore the air flow through the turbine is minimized, has created pressure toward higher operating temperatures in the engines.

Obviously, the use of very hot motive fluid in gas turbines requires combustion apparatus capable of withstanding the intense heat of the combustion process and of the combustion products. This creates problems in cooling of combustion liners within which the combustion occurs. With early combustion liners, operating at relatively moderate temperatures, and in which a great deal of air beyond that required for combustion was supplied, much excess or dilution air could be used in various ways for cooling the liner of the combustion apparatus. This is not to imply that cooling was without problems, but the problems did not arise from a need to conserve cooling air.

Obviously, as the ratio of fuel to air is increased to raise the temperature of the combustion products, the margin of air available for cooling the combustion liner decreases. Generally speaking, it is not possible to have all of the air used for liner cooling ultimately enter effectively into the combustion process. Also, the introduction of cooling air may adversely affect the temperature pattern at the outlet from the combustion liner into the turbine. My invention, therefore, is directed to an approach to the cooling of the combustion liner which I believe to be new and which is particularly valuable in minimizing the quantity of air flow required for cooling the liner, as distinguished from air entering directly into the combustion zone for burning the fuel. While my system of cooling may be regarded in some respects as an improvement of or extension of previously known techniques of liner cooling, it has aspects which go beyond the teachings of the prior art of which I am aware.

The cooling of combustion liners by flow of air between overlapping inner and outer combustion liner walls and along the hot side of the liner, which may be referred to as film cooling, goes back as least as far as Seippel U.S. Pat. No. 2,268,464, and many structures involving this principle have been disclosed in patents and used in practice. These embody various structures of the combustion liner wall and of means for connecting sections of the wall to provide inlets for cooling air in a unitary combustion liner, and to improve the flow of air through the film cooling inlets.

The design philosophy underlying the prior art proposals, so far as I am aware, restricts the cooling flow mainly at one station. The liner pressure drop is therefore expended accelerating the cooling flow to a high velocity at the station. This approach makes little use of the convective cooling potential inherent in the available pressure drop. The resulting high velocity cooling film also is rapidly dissipated into the hot stream because of velocity differences.

My invention, on the other hand, is based upon the theiry that it is better to provide resistance to flow and turbulence of the air entering through the film cooling inlets so as to maximize transfer of heat form the bounding walls to the cooling air, thus reducing the amount of air required for the film cooling. This concept leads to a very substantial reduction, about fifty percent, in the film cooling air required for a combustion chamber and, therefore, advances the art toward the successful operation of stoichiometric and near stoichiometric combustion chambers with metallic liners. Also, the velocity of the cooling air as it enters the liner is relatively low, and compatible with the velocity of flow of combustion gases within the liner. This minimizes shear between the two flows which tends to disturb the cooling air film.

The principal objects of my invention are to improve combustion chamber structures, to provide combustion chambers capable of very high temperature performance, to provide a combustion liner wall having improved provisions for cooling which minimize cooling air requirements, and to modify the surface of the liner walls defining film cooling air inlets so as to increase the rate of heat transfer from the walls to the air entering such inlets. A further object of the invention is to harmonize such objects with the provision of combustion air inlets into the liner which cross the film air inlets without prejudicing the film air cooling. A still further object is to provide practicable and readily manufactured combustion liner structure.

The nature of my invention and its advantages will be clear to those skilled in the art from the succeeding detailed description of the preferred embodiment of the invention and the accompanying drawings.

Figure 1:
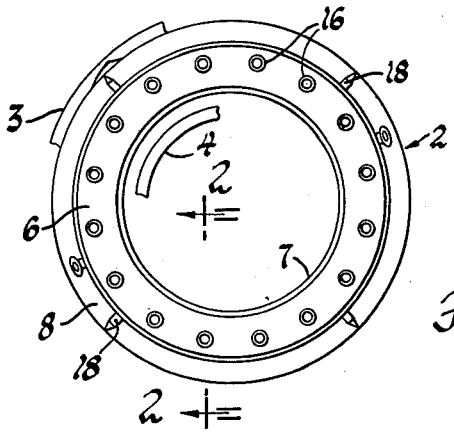
FIG. 1 is a front elevation view of an annular combustion liner with the combustion chamber walls shown fragmentarily.
Figure 2:
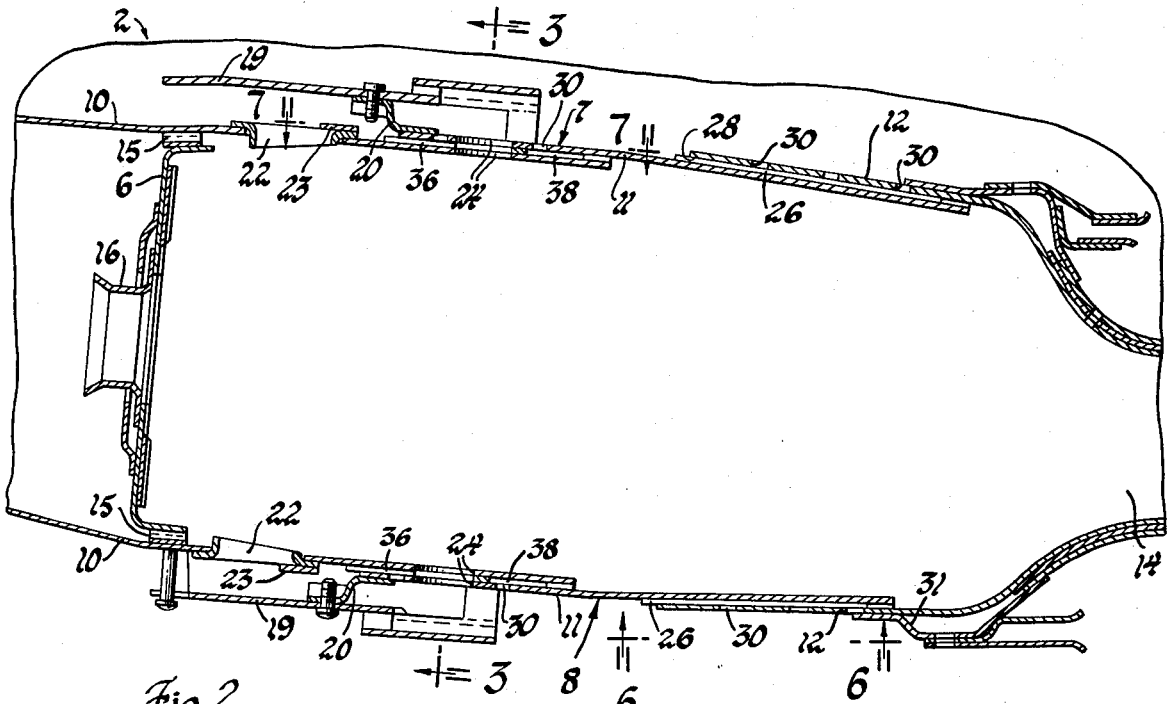
FIG. 2 is a sectional view of the liner taken on a plane substantially containing its axis, as indicated by the line 2—2 in FIG. 1.
Figure 3:
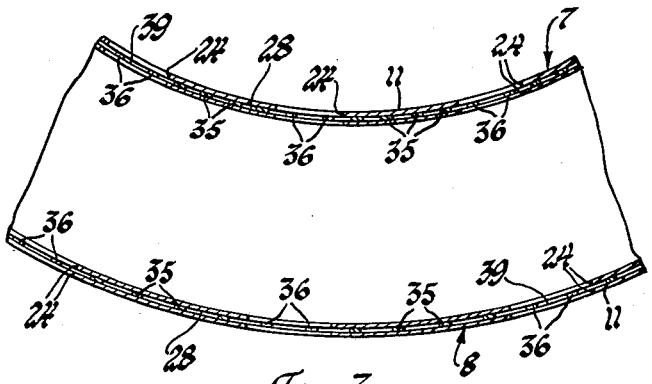
FIG. 3 is a partial cross sectional view taken on the plane indicated by the line 3—3 in FIG. 2.

Referring first to FIGS. 1, 2, and 3, my invention is embodied in an annular combustion liner 2 which is disposed between an outer combustion chamber casing 3 and an inner combustion chamber casing 4, these defining a space to which air under pressure is supplied by a compressor or other suitable apparatus, and from which it flows into the combustion liner 2 within which combustion takes place and from which the combustion products are exhausted to a turbine or other point of use. These are made of suitable high temperature resistant metal, primarily sheet metal.

The combustion liner 2 includes an annular front wall 6, a radially inner wall 7, and an outer wall 8. While there are detail differences between the inner and outer walls, they are the same in principle and, therefore, the sections of the two walls will be identified by the same reference numerals for brevity of exposition. Each of the walls 7 and 8 includes a front section 10, a middle section 11, and a rear section 12. The front sections 10 extend forwardly beyond the front wall 6, and the rear sections 12 converge to define between them an outlet 14 for the combustion products. The outlet end of the combustion liner may be suitably supported on a turbine nozzle (not shown).

The front wall 6 is fixed to the front sections 10 by circumferentially extending zigzag strips 15 which provide annular film cooling air inlets at the forward end of the combustion liner. A number of fuel nozzle sockets 16 are distributed around the front wall. Specifically, there are sixteen sockets. Fuel spray nozzles (not illustrated) enter these sockets. Four supports 18 projecting from the forward part of the liner wall (FIG. 1) serve to center and support the liner. The front wall 6 also includes air inlets to provide air to scour the inner surface of the wall 6, which need not be described here as they are immaterial to my invention.

Baffles 19 supported by rings 20 from the walls 7 and 8 are provided to control the flow of air into the liner. Combustion air flows into the liner through air inlet grommets 22, there being thirty-two such grommets in each wall 7 and 8 in the specific liner illustrated. Small baffles 23 extending over the rear part of the entrance to grommets 22 aid in controlling air flow into the liner. Downstream of grommets 22 there are disposed sixteen additional combustion air inlet holes 24 in each of inner wall 7 and outer wall 8. Before proceeding to a description of the structure associated with these air inlet holes, however, it is best to consider the structure involved in the area of overlap between the middle liner section 11 and the rear section 12.

Figure 9:
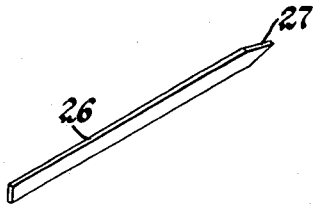
FIG. 9 is an axonometric view of a coupling strip which connects the liner sections.

Referring to FIGS. 2, 3, and particularly 6, which last figure shows the joint between middle and rear sections of the outer liner wall 8, there is a very substantial overlap between the wall sections 11 and 12. Throughout this overlap area the wall sections are maintained uniformly spaced from each other and are physically coupled to each other through coupling strips 26 (see also FIG. 9) which are thin narrow toothpick-like elements of sheet metal of rectangular outline except that the end 27 which is disposed downstream in the combustion liner is pointed. In the specific case, these are three hundredths of an inch thick. The coupling strips 26 are bonded to the wall sections which they thus mechanically interconnect. The cooling air inlets 28 between sections 11 and 12 are defined by the gap between these two liner sections and between adjacent coupling strips 26. In the particular example illustrated, there are one hundred and twenty such coupling strips in the outer wall and eighty in the inner wall, which is of smaller diameter, so that the distance between the strips in both cases is about one-half inch. Each coupling strip 26 is brazed to the wall section 11 and, when the liner is assembled, lies under two or more holes 30 in the section 11 (three or more holes 30 in the inner wall section 12). In the assembly of the combustion liner, the shaped holes 30 are filled with weld or braze metal to mechanically lock the sections 11 and 12 of the liner together through the strips 26. Since strips 26 are numerous and closely spaced, they preserve the spacing of the two liner sections and, therefore, the dimension radially of the combustion liner of the air inlet 28.

Figure 6:
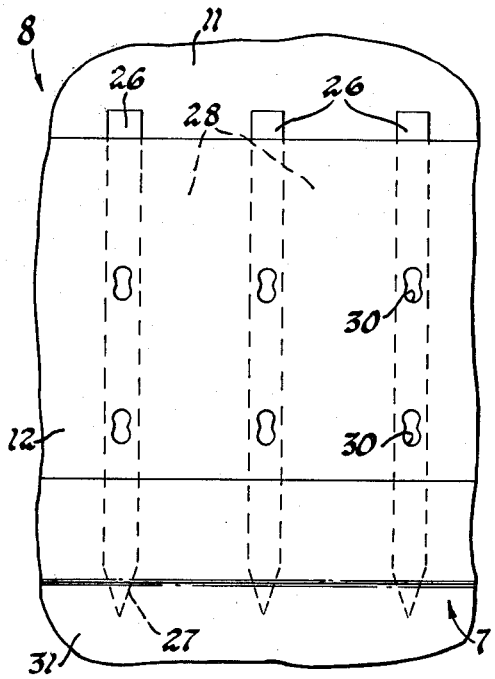
FIG. 6 is a fragmentary plan view illustrating a portion of the overlap between the second and third sections of a liner wall.

FIGS. 2 and 6 also illustrate an outer wall layer 31 which forms part of the structure by which the combustion liner is supported in the engine. The coupling strips 26 are approximately 0.03 inch thick so that the air inlet 28 is about this width. The tapered or pointed end 27 of the coupling strips 26 causes the air passing through the entrance 28 to spread out uniformly over the inner surface of the combustion liner wall downstream of the coupling strips.

Figure 4:
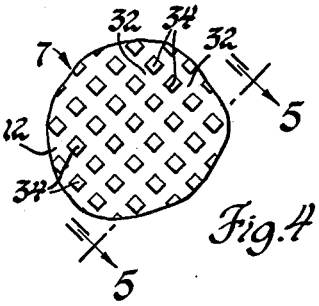
FIG. 4 is an enlarged fragmentary view showing the roughened surface of the wall of the combustion liner film cooling air inlet.
Figure 5:
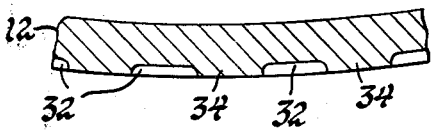
FIG. 5 is a still further enlarged section of the same, taken on the line indicated by the line 5—5 in FIG. 4.

For improved utilization of the cooling air in accordance with my invention, the portions of the wall sections 11 and 12 which are in mutually overlapping relation have their confronting faces specially roughened so as to create turbulence in the air flow through the cooling air inlet 28 and improve heat transfer from the walls, particularly to the wall 11 which is on the combustion side or inside of the liner. In the preferred embodiment of my invention, the metal of the walls 11 and 12 is approximately 0.04 inch thick. To provide the rough surface as illustrated in FIGS. 4 and 5, the surface is chemically etched to a depth of approximately 0.007 inch to provide a grid of intersecting grooves 32 which have between them projecting generally rectangular bosses 34 about 0.02 to 0.03 inch in width where no etching takes place. These chemically etched surfaces extend from the forward edge of section 12 to the rearward edge of section 11, thus providing the roughened surface on both boundaries of the cooling air inlet.

It has been found that more effective cooling can be obtained in this respect than with a prior structure with normally smooth sheet metal surfaces on the walls for the cooling air inlets and in which the air flow was about fifty percent greater, leading to much greater dilution of the combustion products. The air which flows from the rear end of the passage 28 will flow over the inner surface of the rear wall section 12 to achieve some measure of film cooling at this point.

The arrangement of the cooling air inlets between the front wall section 10 and middle wall section 11 is based upon the same principles as between the middle and rear wall sections. However, there are substantial modifications or additions because of the presence of the large air inlets 24 which lie approximately midway of the overlap between the front and middle wall sections in both the inner and outer walls. In the particular example shown, there are sixteen holes 24 through each wall. Four coupling strips 35, which may be identical to the coupling strips 26 except of somewhat different length, join the wall sections 10 and 11 between each two adjacent combustion air holes 24 in the inner wall; and six such coupling strips 26 lie between each two adjacent air holes 24 in the outer wall 8 in which, of course, the holes 24 are spaced farther apart.

Figure 7:
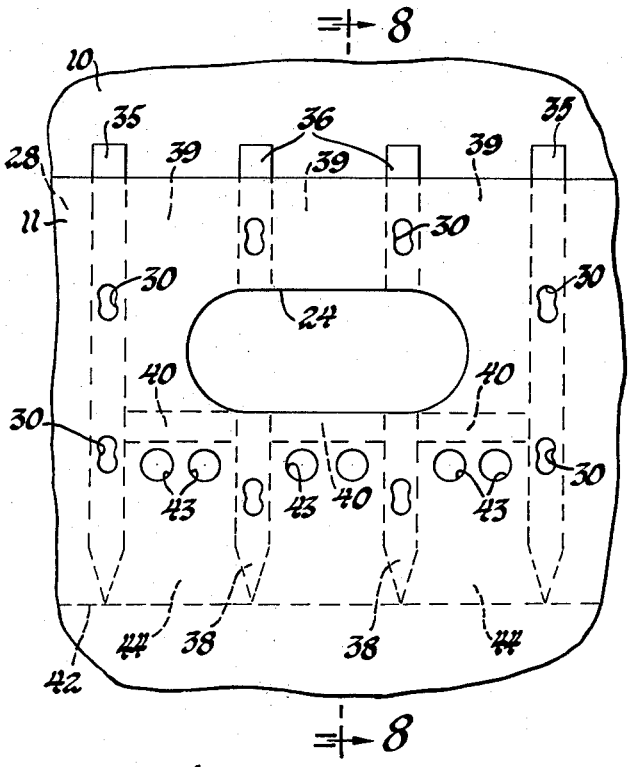
FIG. 7 is a fragmentary plan view illustrating a portion of the overlap between the first and second sections of the liner wall.
Figure 8:
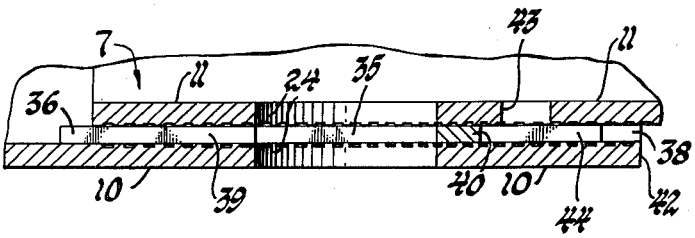
FIG. 8 is an enlarged fragmentary sectional view taken on the plane indicated by the line 8—8 in FIG. 7.

To space and couple the wall sections in the region of the holes 24, front strips 36 (FIGS. 7 and 8) are provided upstream of openings 24 and rear strips 38 rearwardly of openings 24. It will be seen the strips 36 and 38 taken together are essentially the same as strips 35 except that the gap between them leaves the air entrance 24 clear. The liner section 11 has two braze metal holes 30 of figure eight configuration over each strip 35 and one over each strip 36 or 38. Strips 35, 36, and 38 are welded to the forward liner section 10. Holes 24 extend through both the wall sections 10 and 11 and are aligned with each other at the time the liner is assembled.

Since the air flow through holes 24 would intercept or block the flow through the passages 39 between the coupling strips which are intersected by holes 24, the air flowing from the forward part of these inlets is allowed to flow into the combustion liner through the holes 24. This leaves a need for cooling of the overlapping portions of liner sections 10 and 11 in the areas downstream of the holes 24. It is important to provide cooling here and to avoid recirculation of hot combustion products between the wall sections. To accomplish this, blocking strips 40 welded to the liner section 10 extend from the coupling strip 35 to the adjacent rear strip 38 and between the rear strips 38 so that the air inlets 39 are blocked off to the rear of combustion air hole 24. To cool the portion of wall 10 between each hole 24 and the rear edge 42 of wall 10, two small auxiliary cooling air holes 43 are punched through the rear or outer wall 11 immediately downstream of blocking strips 40.

Air entering through holes 43 flows through passages 44 defined between the walls and between the rear strips 38 and between these strips and the adjacent strips 35. In the portions of the inlet remote from the combustion air holes 24, the flow is as previously described through inlets 28 between strips 35.

It may not be obvious why the outer wall (away from the flame) of the air inlets 28 is roughened, since the inner wall is the one requiring most of the cooling. However,roughening both walls increases turbulence and thus benefits heat transfer from the hot wall of the cooling air inlet. If only the inner wall is roughened, the cooling air flow may follow the outer wall to the detriment of cooling of the inner wall, and more air may be required for the same cooling effect.

It should be apparent from the foregoing to those skilled in the art that the structure described is a combustion liner of very practical structure, readily assembled, and that it particularly provides for cooling of the walls with a minimum of air flow and primarily by cooling of the walls by convection rather than by pure film cooling, since the overlapping portions of the combustion liner wall are much greater in extent than the portions between the overlaps.

The detailed description of the preferred embodiment of the invention for the purpose of explaining the principles thereof should not be considered as limiting or restricting the invention, since many modifications may be made by the exercise of skill in the art within the scope of the invention.

I claim:

1. A combustion liner for a gas turbine engine combustion chamber or the like, the liner being of a type dividing an air space, from which combustion air is supplied, from a combustion space in which air and combustion products flow longitudinally of the liner to a combustion products outlet, the liner including a wall dividing the air space from the combustion space: the wall comprising, in combination, a forward wall section and a rearward wall section; the rearward wall section including a portion overlapping and outwardly spaced from the forward wall section, the forward wall section including a portion overlapping and inwardly spaced from the rearward wall section, the said portions defining between them an inlet from the air space to the combustion space for cooling air to flow along the rearward wall section for film cooling of the rearward wall section; the said wall portions defining combustion air holes extending through the said wall portions for flow transverse to the cooling air flow; barrier means blocking the cooling air inlet downstream of the combustion air holes; and auxiliary cooling air inlets defined by and extending through the rearward wall section into the cooling air inlet immediately downstream of the barrier means.

2. A combustion liner as recited in claim 1 including coupling strips disposed between and bonded to the said wall portions mechanically connecting the wall portions and establishing the width of the cooling air inlet.

3. A combustion liner as recited in claim 2 in which some of said coupling strips are in two parts, respectively forward of the combustion air holes and rearward of the combustion air holes.

* * * * *